US006042021A

United States Patent [19]

Clark

[11] Patent Number: 6,042,021

[45] Date of Patent: Mar. 28, 2000

[54] ARC ADJUSTMENT TOOL LOCKING MECHANISM FOR POP-UP ROTARY SPRINKLER

[75] Inventor: Mike Clark, San Marcos, Calif.

[73] Assignee: Hunter Industries, Inc., San Marcos, Calif.

[21] Appl. No.: 09/203,229

[22] Filed: Nov. 30, 1998

[51] Int. Cl.[7] ..... B05B 3/16; B05B 15/10

[52] U.S. Cl. ..... 239/205; 239/206; 239/242; 239/DIG. 1

[58] Field of Search ..... 239/200, 201, 239/203, 204, 205, 206, 237, 210, 241, 242, DIG. 1

[56] References Cited

U.S. PATENT DOCUMENTS

| | | | |
|---|---|---|---|
| 3,107,056 | 10/1963 | Hunter . | |
| 3,785,565 | 1/1974 | Perry et al. | 239/242 X |
| 4,773,595 | 9/1988 | Livne | 239/242 |
| 4,919,337 | 4/1990 | Van Leeuwen et al. | 239/206 X |
| 5,330,103 | 7/1994 | Eckstein | 239/242 |
| 5,423,486 | 6/1995 | Hunter | 239/206 X |
| 5,456,411 | 10/1995 | Scott et al. | 239/206 X |
| 5,676,315 | 10/1997 | Han | 239/206 X |
| 5,765,757 | 6/1998 | Bendall | 239/242 C |

*Primary Examiner*—Lesley D. Morris
*Attorney, Agent, or Firm*—Michael H. Jester

[57] ABSTRACT

A pop-up rotary sprinkler with adjustable arc limits has an arc adjustment tool engaging member slideably mouted in a guide sleeve in the head of the sprinkler that has a progressively narrowing diameter. The member includes a radially expandable and contrastable collet at the upper end thereof and a pinion gear at a lower end thereof for engaging the teeth of a bull gear for setting at least one of the end limits of the desired arc. When the tool is inserted into the member, it moves downwardly, and a pair of flanges of the tool are locked into slots in the collet. The tool cannot be removed until it is pulled upwardly to permit the collet to expand radially to allow the flanges of the tool to be pulled past a ring at the upper end of the collet.

20 Claims, 6 Drawing Sheets

ARC ADJUSTMENT TOOL LOCKING MECHANISM FOR POP-UP ROTARY SPRINKLER

BACKGROUND OF THE INVENTION

The present invention relates to irrigation equipment, and more particularly, to rotor-type sprinklers that spray water over an adjustable arc.

Rotor-type sprinklers are widely used for watering lawns, golf courses, athletic fields and other landscaping. Typically such a sprinkler includes a cylindrical outer housing with a central riser that extends upwardly when the water is turned ON and retracts when the water is turned OFF. A head at the upper end of the riser includes a nozzle that directs a stream of water over the adjacent area. The head is rotated about a vertical axis by an internal turbine and gear drive through an predetermined arc whose ends limits are usually manually adjustable with a special tool. See for example, U.S. Pat. No. 3,107,056 granted Oct. 15, 1963 to Edwin J. Hunter and U.S. Pat. No. 4,568,024 granted Feb. 4, 1986 to Edwin J. Hunter.

Adjustable arc pop-up sprinklers typically have a reversing mechanism associated with the gear drive for the head. The direction of the water stream from the nozzle thus oscillates between pre-set end limits. These ends limits are usually trip points. For the sake of simplicity usually one end limit is fixed and the other end limit is moved along a circumferential ring or bull gear. Thus sector areas for watering can be pre-programmed such as forty-five degrees, seventy degrees, one hundred and eighty degrees, two hundred and seventy degrees, etc.

Conventional arc adjustable rotary sprinklers are usually provided with a circular opening in the top surface thereof which receives the shaft of an arc adjustment tool which is manually inserted and twisted by the sprinkler installer or landscape maintenance worker to adjust the arc of the sprinkler. The receptacle into which the tool is inserted normally has a spring to force the tool back upward when the adjustment is complete. This requires the tool to be manually held down in order to adjust the arc. It is cumbersome and tedious to both hold down the tool and twist the same to set the arc of the sprinkler.

SUMMARY OF THE INVENTION

It is therefore the primary object of the present invention to provide an adjustable arc rotary sprinkler with an improved arc adjustment tool receptacle mechanism that makes it easier to adjust the arc.

In accordance with the present invention, a sprinkler includes a housing having an outlet end, a head including a nozzle for ejecting a stream of water and a mechanism for mounting the head at the outlet end of the housing for angular rotation about a vertical axis. A drive mechanism is mounted in the housing for driving the head about the axis. An arc adjustment mechanism mounted in the housing allows pre-setting of at least one of a pair of end limits of rotation of the head. A reversing mechanism in the housing causes the rotation of the head to reverse a direction of rotation thereof when a rotational position of the head reaches each of the end limits so that the stream of water will travel through a predefined angular sector. An arc adjustment tool engaging member is mounted in the head for receiving a portion of an arc adjustment tool. The member cooperates with the arc adjustment mechanism to permit manual rotation of the tool to pre-set the one end limit of rotation of the head. The arc adjustment tool engaging member is moveable between an extended position in which the member is disengaged with the arc adjustment mechanism and a retracted locked position in which the tool need not be held down during rotation of the tool in order to adjust the one end limit of the arc.

DESCRIPTION OF THE PREFERRED EMBODIMENT

Figure 1:
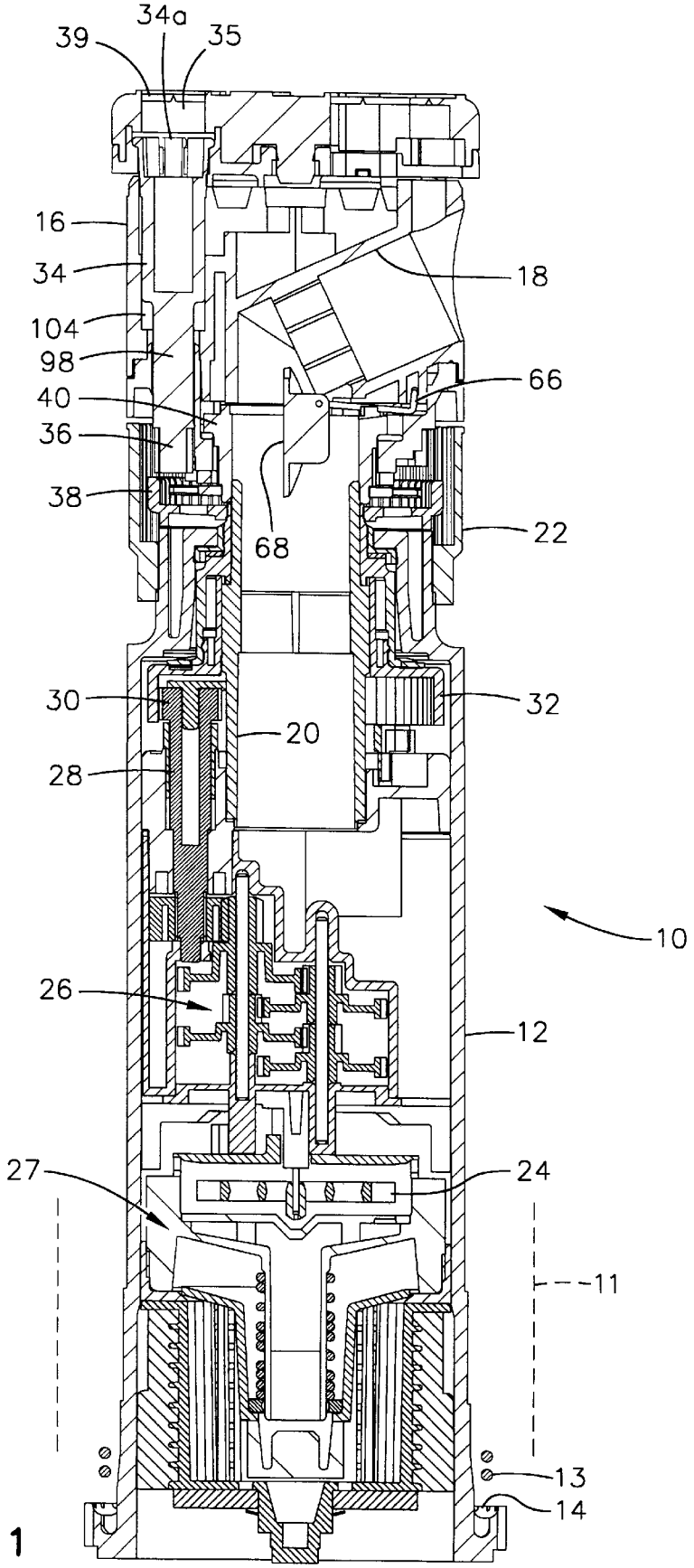
FIG. 1 is a vertical sectional view of a pop-up rotary sprinkler incorporating a preferred embodiment of the present invention.

Referring to FIG. 1, in accordance with the present invention a pop-up rotary sprinkler 10 has a cylindrical outer housing 11 shown diagrammatically as a pair of phantom lines. The outer housing 11 has a female threaded lower end (not illustrated) that screws over a male threaded fitting (not illustrated) connected to a pressurized water supply line (not illustrated). Unless otherwise indicated all parts of the sprinkler 10 are preferably made of injection molded plastic for economy, strength and durability. The sprinkler 10 includes a cylindrical inner housing or riser 12 mounted concentrically within the outer housing 11. The riser 12 extends upwardly from the outer housing 11 when the water pressure is turned ON. When the water is turned OFF, the riser 12 retracts within the outer housing 11 under the force of a metal coil retracting spring 13 shown diagrammatically in FIG. 1. The ends of the coil spring 13 captured between an upwardly opening retaining flange 14 at the lower end of the riser 12 and a shoulder (not illustrated) at the upper end of the outer housing 11.

The riser 12 (FIG. 1) has an upper outlet end including a rotating head 16 having a nozzle 18 for ejecting an inclined stream of water (not illustrated) over the landscaping to be watered. When the riser 12 is fully retracted, the upper end of the head 16 is flush with the upper end of the outer housing 11, which is in turn flush with the level of the ground in which the sprinkler 10 is installed in subterranean fashion.

The head 16 (FIG. 1) is releasably coupled to the upper end of a large centrally located hollow central drive shaft 20 by a clutch assembly 22. The clutch assembly 22 provides a memory arc mechanism. The central drive shaft 20 defines a tubular vertical passage through which water is conveyed to the nozzle 18. A conventional water powered drive mechanism in the form of a water turbine 24 and a gear reduction 26 rotate the central drive shaft 20 about a vertical axis at a predetermined slow angular rate. The gear reduction 26 is made up of a plurality of intermeshing gears that rotate around parallel metal shafts. The rate of rotation of the central drive shaft 20 is kept substantially uniform by a conventional stator assembly 27 that operates as a pressure regulator to maintain rotor RPM within a narrow range despite fluctuations in water pressure. Other forms of water powered drive mechanism besides the turbine may be used, such as an impact drive.

The gear reduction 26 is coupled to the drive shaft 20 through an asymmetrically located vertical drive shaft 28 having a pinion gear 30 that drives a shiftable gear train that engages a toothed inner surface of a bull gear 32. A conventional arc adjustment mechanism is provided for pre-setting one of a pair of adjustable end limits of rotation of the head 16. A conventional reversing mechanism causes rotation of the head 16 to reverse each time it reaches each of the pre-set end limits so that the stream of water will travel through a predefined angular sector. This causes the stream of water from the nozzle 18 to oscillate through a predetermined arc. The end limit and reversing mechanisms are physically associated with the bull gear 32.

Arc adjustment and reversal mechanisms for rotary sprinklers are well known in the irrigation sprinkler art. See for example, U.S. Pat. Nos. 3,107,056; 4,568,024; 4,624,412; 4,718,605 and 4,948,052 of Edwin J. Hunter, the entire disclosures of which are hereby incorporated by reference. Where the drive mechanism is the impulse type, the reversal mechanism may consist of a series of vents and ports with movable members for diverting water flow to reverse the direction of movement of the head, as disclosed in U.S. Pat. No. 4,625,914. In the sprinkler 10 of FIG. 1, one end limit of the arc is conveniently manually adjustable via an elongate cylindrical collet 34, the upper end 34*a* of which is accessible with a special tool 100 (FIG. 8) through a cylindrical opening 35 in the top of the head 16. This allows a pinion gear 36 (FIG. 1) connected to the collet 34 to engage the inwardly facing teeth of a bull gear 38 for setting one of the arc limits. The other arc limit is normally fixed although both arc limits could be adjustable. The opening 35 may be sealed by an elastomeric cover 39 with a cross-hair slit that allows entry of the shaft of an arc adjustment tool hereafter described.

The clutch assembly 22 (FIG. 1) couples the upper end of the central drive shaft 20 to the head 16. The clutch assembly 22 is configured to disengage the head 16 with the central drive shaft 20 when the head 16 is manually twisted or is held against rotation, e.g. by a vandal to cause rotation of the head 16 to be forced to a first rotational position outside the end limits. Thereafter the clutch assembly 22 automatically engages and disengages the head 16 and the central drive shaft 20 to rotate the head 16, in stepped fashion, back to a second rotational position inside the end limits. The stream of water from the nozzle 18 will then once again oscillate through the predetermined arc.

The clutch assembly 22 includes a clutch head 40 whose lower end is fixedly secured by spin welding, sonic welding or other suitable permanent attachment method to the upper end of the central drive shaft 20 as shown in FIG. 1. The clutch assembly 22 thus provides a memory arc feature. When the head 16 is forced by a vandal, a linkage arm 66 pivots a valve member 68 to close the central passage of the drive shaft 20. In this fashion, the stream of water is substantially shut off until the head 16 returns to oscillation within its pre-set limits. Further details of the memory arc and throttling valve features may be found in my co-pending U.S. patent application Ser. No. 09/198,911 filed Nov. 24, 1998 and entitled ROTARY SPRINKLER WITH MEMORY ARC MECHANISM AND THROTTLING VALVE the entire disclosure of which is specifically incorporated herein by reference.

FIG. 3–7 illustrate details of the mechanisms of the sprinkler of 10 of FIG. 1 which permit the pre-setting of one of the pair of end limits of rotation, as well as details of the head reversing mechanism. The rotational position of one end limit 70 (FIG. 3) is adjustable by twisting the shaft or central sleeve 102*c* of the tool 100 (FIG. 8) inside of the collet 34. The other end limit 74 (FIG. 5) is fixed. A stop 75 affixed to the outside of the bull gear 32 engages the end limit 70 to prevent it from moving past the same. The head reversing mechanism includes a train of four gears 76, 78, 80 and 82 (FIG. 4) that are shiftable to engage the toothed inner surface of the bull gear 32 via over-center springs 84 and 86 and cam 88. The locations of the drive shaft 28, pinion gear 30 and bull gear 32 are further illustrated in FIGS. 6 and 7.

Figure 2:
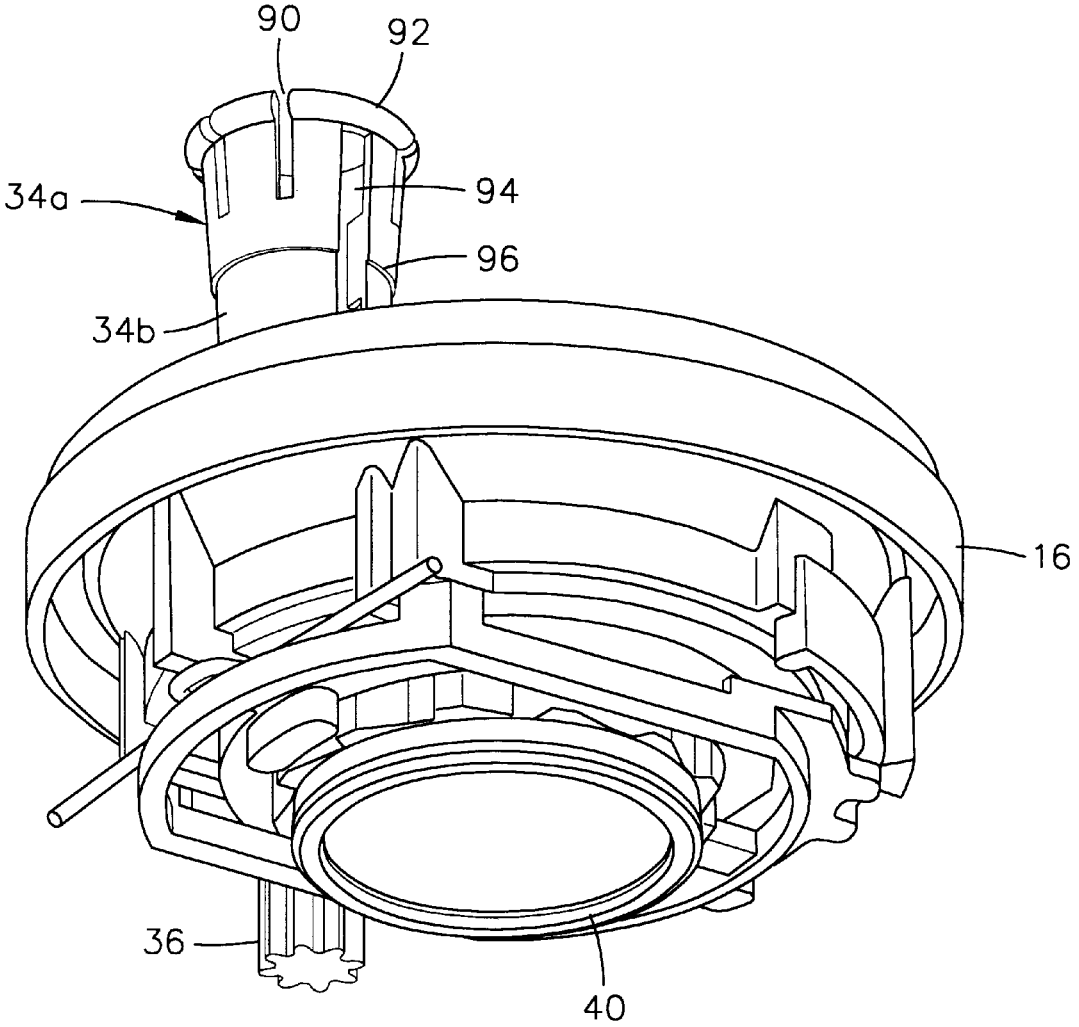
FIG. 2 is an enlarged perspective view of the top portion of the sprinkler of FIG. 1 illustrating details of its arc adjustment tool locking mechanism.
Figure 3:
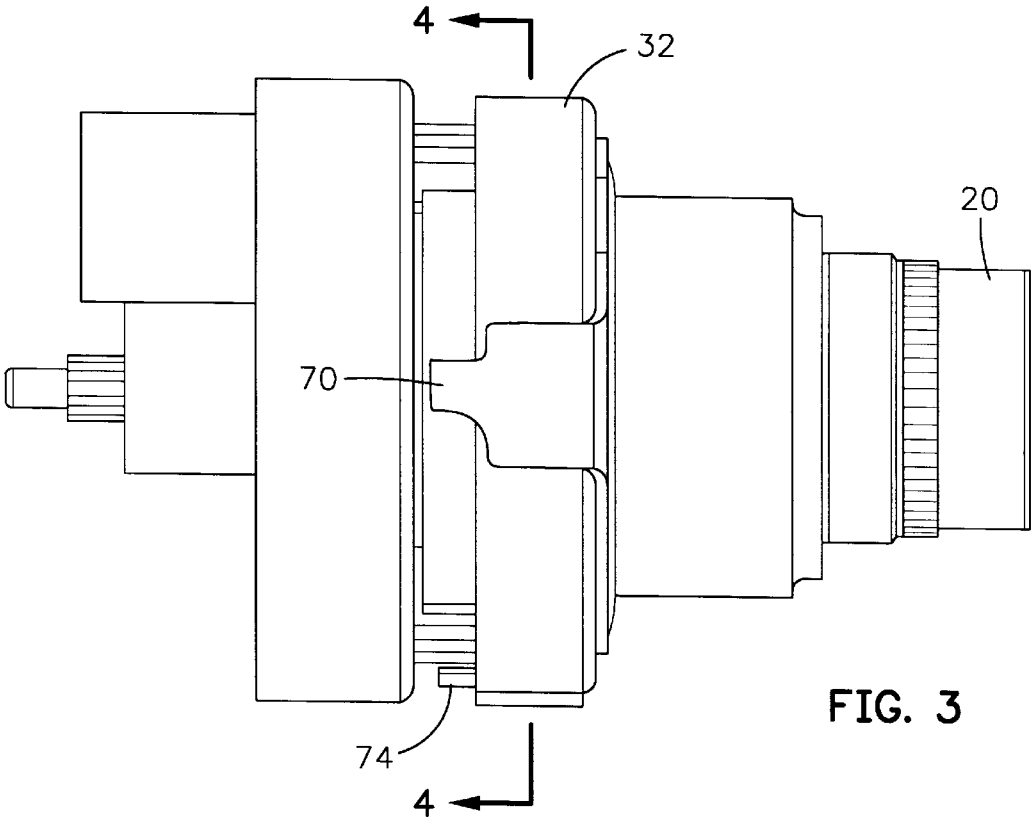
FIG. 3 is an enlarged side elevation view of a portion of the sprinkler of FIG. 1 showing details of its mechanism for pre-setting one of its end limits of rotation of its nozzle containing head.
Figure 4:
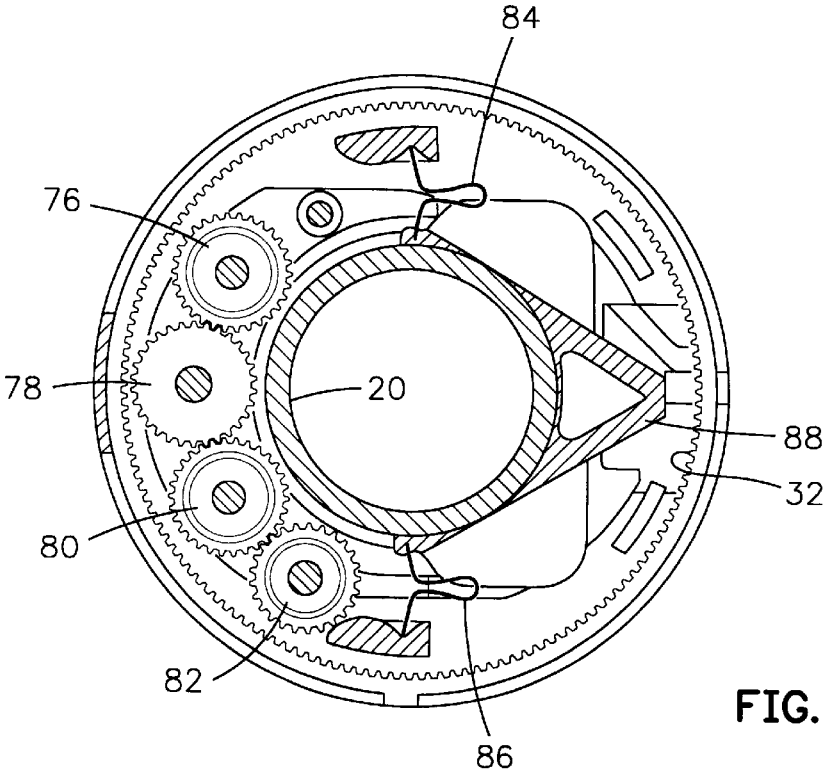
FIG. 4 is a cross-sectional view taken along line 4—4 of FIG. 3 showing details of the head reversing mechanism of the sprinkler of FIG. 1.
Figure 5:
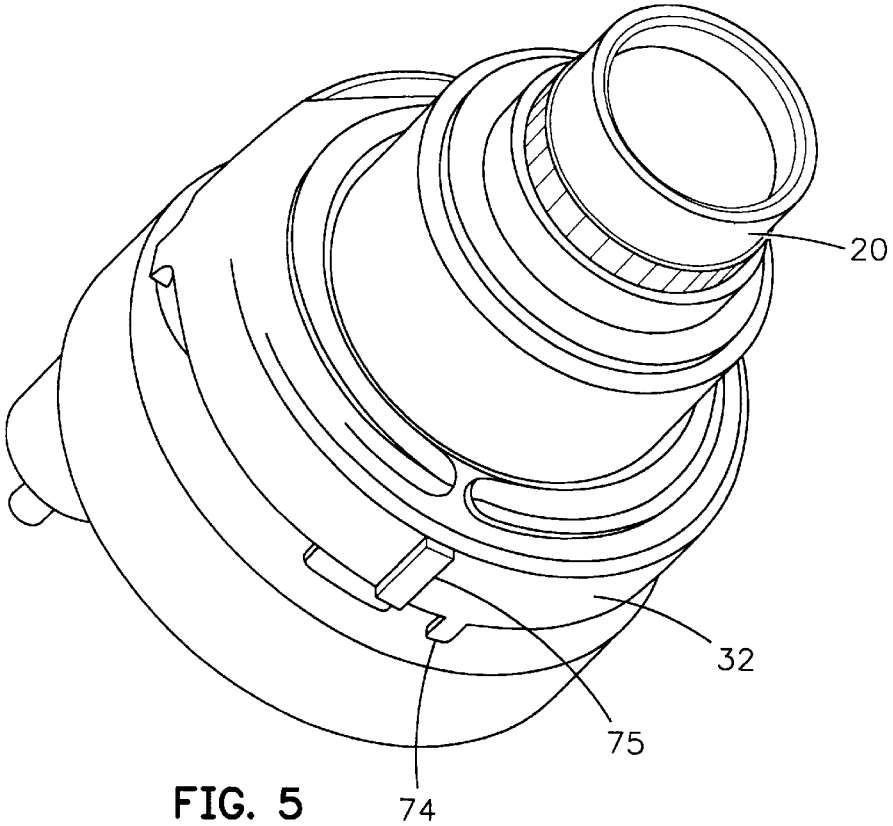
FIG. 5 is a perspective view the portion of the sprinkler illustrated in FIG. 3 showing further details of its mechanism for pre-setting one of its end limits of rotation of its nozzle containing head.
Figure 6:
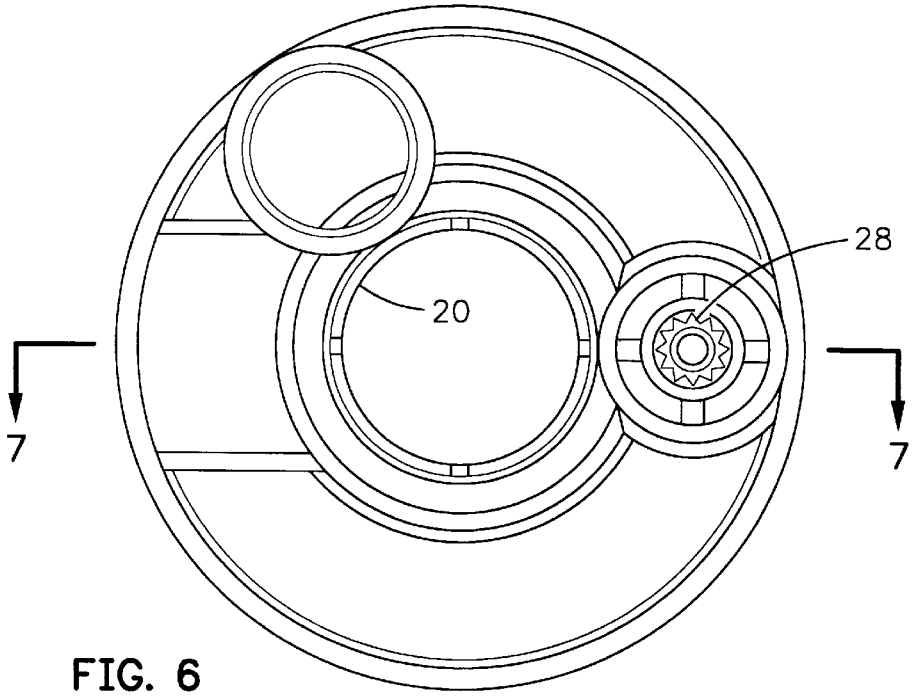
FIG. 6 is a bottom plan view of the portion of the sprinkler illustrated in FIG. 3 taken from the left side of FIG. 3.
Figure 7:
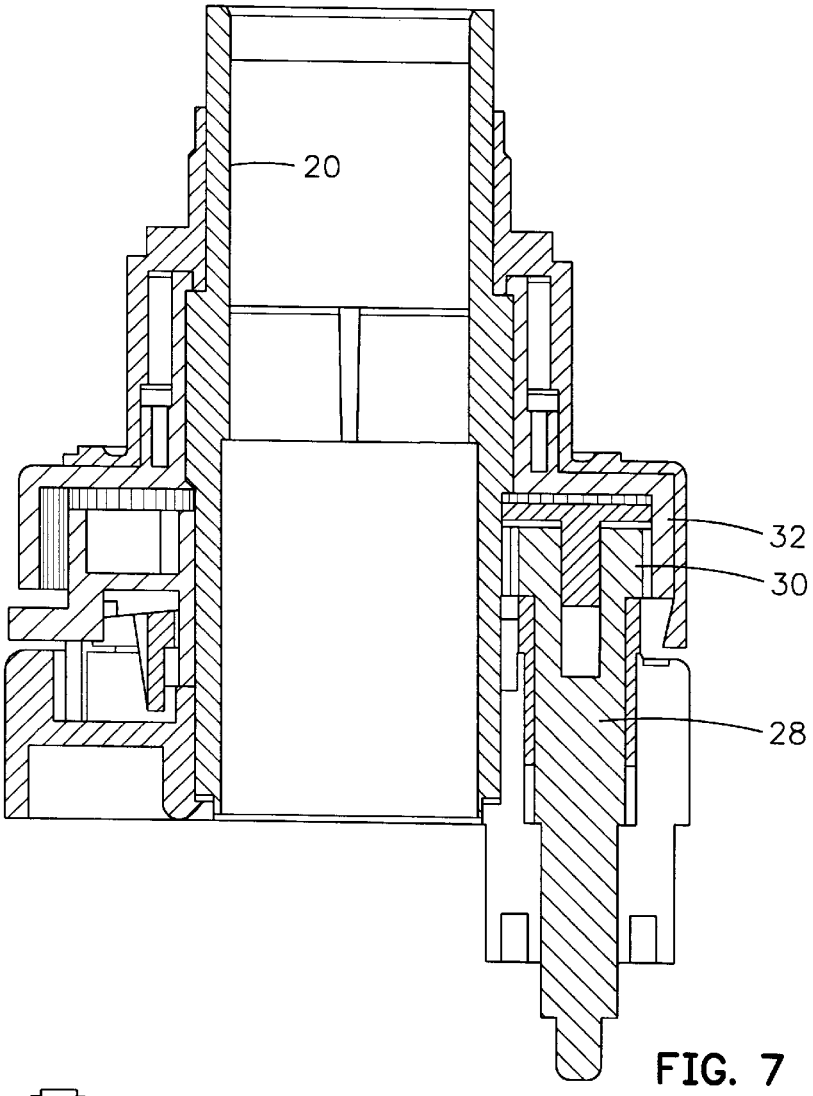
FIG. 7 is a vertical sectional view of the portion of the sprinkler illustrated in FIG. 6 taken along line 7—7 of FIG. 6.

Referring to FIG. 2, the upper segment 34*a* of the collet 34 has a plurality of circumferentially spaced, longitudinally extending slits 90 that extend through a rounded annular upper ring 92. The upper segment 34*a* of the collet 34 further has an opposing pair of longitudinally extending slots 94. The slots 94 do not extend through the ring 92. A lower segment 34*b* of the collet 34 has a diameter that is slightly smaller than that of the upper segment 34*a* thereby forming a small step or shoulder 96. A solid cylindrical shaft 98 (FIG. 1) connects the pinon gear 36 to the lower segment 34*b* of the collet 34.

Figure 8:
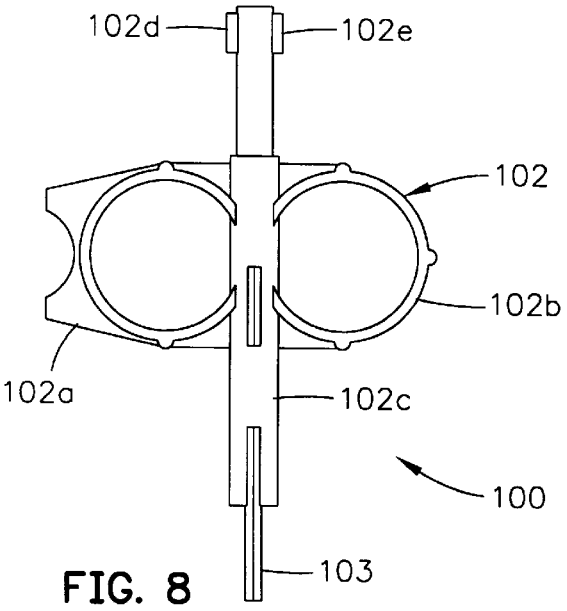
FIG. 8 is a plan view of a tool for adjusting the arc limits of the sprinkler of FIG. 1.

FIG. 8 illustrates details of the arc adjustment tool 100. The tool 100 may be used with the pop-up sprinkler of FIG. 1 to adjust one of its arc limits. It includes a molded plastic portion 102 and a metal rod portion 103. The plastic portion 102 includes a pair of finger rings 102*a* and 102*b* formed on opposite sides of a central support sleeve 102*c*. An upper end of the support sleeve 102*c* surrounds and holds a majority of the metal rod portion 103. The plastic portion 102 further includes a pair of small rectangular flanges 102*d* and 102*e* that extend from opposite sides of the lower end of the support sleeve 102*c*. The distance between the outer lateral edges of the two flanges 102*d* and 102*e* is just slightly larger than the inside diameter of the ring 92 (FIG. 2) of the upper segment 34*a* of the collet 34.

Figure 9:
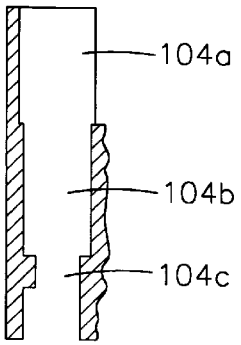
FIG. 9 is an enlarged diagrammatic illustration showing the dimensions of a cylindrical guide sleeve in the head of the sprinkler of FIG. 1.

Referring again to FIG. 1, a cylindrical vertical guide sleeve 104 is formed in the head 16 for holding and guiding the collet 34, shaft 98 and pinion gear 36, which are all injection molded of plastic as one integral unit. FIG. 9 is a diagrammatic illustration showing the dimensions of the cylindrical guide sleeve 104. It has an upper segment 104*a* with a diameter that is slightly larger than an outer diameter of the upper segment 34*a* of the collet 34. The guide sleeve 104 has an intermediate segment 104*b* with a diameter that is slightly larger than an outer diameter of the lower segment 34*b* of the collet 34. A lower segment 104*c* of the guide sleeve 104 has a diameter which is slightly larger than an outer diameter of the shaft 98.

The lower end of the support sleeve 102c (FIG. 8) of the arc adjustment tool 100 having the flanges 102*d* and 102*e* can be manually inserted though the cross-hair aperture in the elastomeric cover 39. At this time, the collet 34 is in its upper or fully extended position illustrated in FIG. 1. Downward pushing on the tool 100 forces the upper collet segment 34*a* to radially expand. The slits 90 permit the ring 92 to radially expand slightly so that the flanges 102*d* and 102*e* can slide past the same. The tool 100 is then manually twisted until the flanges 102*d* and 102*e* slide into corresponding ones of the slots 94 (FIG. 2). Thereafter, continued downward pressure on the tool 100 causes the combination collet 34, shaft 98 and pinion gear 36 to move downwardly in the guide sleeve 104 formed in the head 16.

Figure 10:
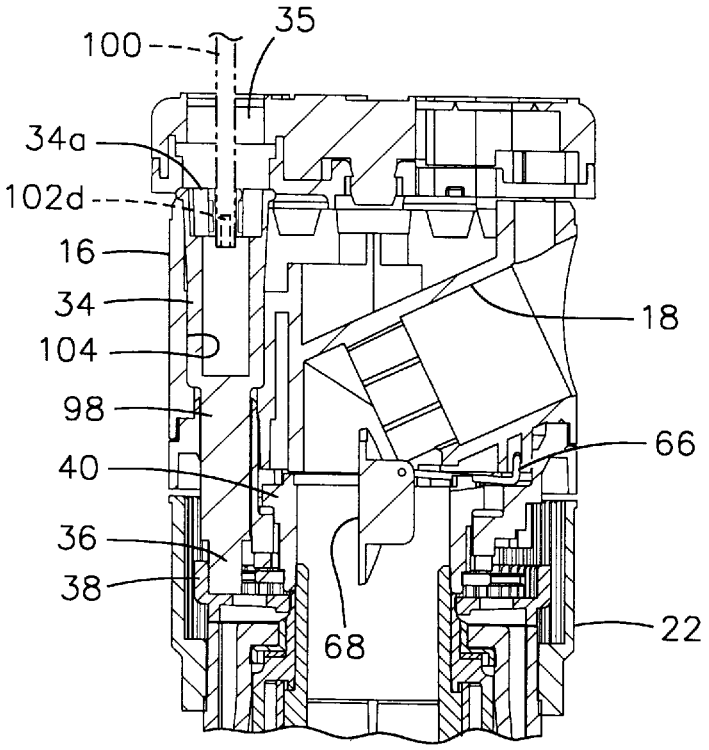
FIG. 10 is a portion of FIG. 1 showing the head of the sprinkler with an arc adjustment tool shown in phantom lines inserted into the collet which forms a part of the arc adjustment tool locking mechanism.
Figure 11:
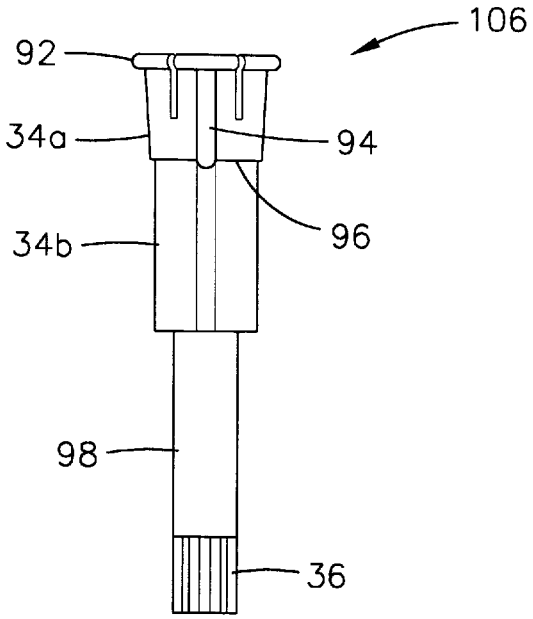
FIG. 11 is a reduced side elevation view of the arc adjustment tool engaging member that forms a part of the sprinkler of FIG. 1.

The combination of the collet 34, shaft 98 and pinion gear 36 are collectively referred to herein as an arc adjustment tool engaging member. This member is labeled 106 in FIG. 11. FIGS. 1 and 10 illustrate the fully extended and fully retracted positions, respectively, of the arc adjustment tool engaging member 106. When the arc adjustment tool engaging member 106 is in its fully retracted position illustrated in FIG. 10, the teeth of the pinion gear 36 are engaged with the inwardly facing teeth of the bull gear 38. The tool 100 can be twisted to move the position of the end limit 70 (FIG. 3) to thereby set the arc of the sprinkler 10. Because there are no springs acting on the arc adjustment tool engaging member 106, it is not necessary for the landscape maintenance person to hold down on the tool 100 while he or she twists the same to set the arc limit 70. A shoulder formed at the junction of the lower collet segment 34*b* and the shaft 98 engages a shoulder formed between the segments 104*b* and 104*c* of the guide sleeve 104. This provides a limit or stop against further downward movement of the arc adjustment tool engaging member 106.

When the collet 34 (FIG. 1) is pushed downwardly inside the guide sleeve 104, the relationship of the diameters of these concentric structures is such that the collet 34 is slightly squeezed inwardly and contacts radially around the lower end of the sleeve 102c of the tool 100. This captures and locks the flanges 102*d* and 102*e* in the slots 94. The position of the flanges 102*d* and 102*e* at this time is shown in phantom lines in FIG. 10. When the arc adjustment has been completed, the tool 100 is pulled upwardly. The flanges 102*d* and 102*e* engage the underside of the ring 92 (FIG. 2) of the collet end 34*a*. The arc adjustment tool engaging member 106 is pulled upwardly back to its fully extended position illustrated in FIG. 1. Due to the progressively enlarging diameter of guide sleeve 104 the ring 92 is eventually allowed to expand radially a sufficient amount so that the flanges 102*d* and 102*e* can be pulled past the same. When the collet 34 is returned to its fully extended position illustrated in FIG. 1, the pinion gear 36 is disengaged from the bull gear 38. It will thus be understood that the tool 100 cannot be withdrawn from the head 16 unless the arc adjustment tool engaging member 106 is pulled back to its fully extended position illustrated in FIG. 1.

I have not described all of the details of my sprinkler 10 illustrated in FIG. 1 as such details will be apparent from the drawing figures taken collectively, in light of my discussion and my reference to other patents. The configuration of the various parts illustrated herein could be varied as necessary to meet the specific design parameters of a particular application. I have provided a sprinkler with an improved arc adjustment tool locking mechanism.

Whereas a preferred embodiment of a sprinkler incorporating my arc adjustment tool locking mechanism has been described in detail, it will be understood that modifications and adaptations thereof will occur to those skilled in the art. Therefore, the protection afforded my invention should only be limited in accordance with the scope of the following claims.

I claim:

1. A sprinkler, comprising:

a housing having an outlet end;

a head including a nozzle for ejecting a stream of water;

means for mounting the head at the outlet end of the housing for angular rotation about vertical axis;

means mounted in the housing for driving the head about the axis;

arc adjustment means mounted in the housing for pre-setting at least one of a pair of end limits of rotation of the head;

means for causing the rotation of the head to reverse a direction of rotation thereof when a rotational position of the head reaches each of the end limits so that the stream of water will travel through a predefined angular sector; and an arc adjustment tool engaging member mounted in the head for receiving a portion of an arc adjustment tool and cooperating with the arc adjustment means to permit manual rotation of the tool to pre-set the one end limit of rotation of the head, the arc adjustment tool engaging member being moveable between an extended position in which the member is disengaged with the arc adjustment means and a retracted locked position in which the tool need not be held down during rotation of the tool in order to adjust the one end limit.

2. The sprinkler according to claim 1 wherein the head has a guide sleeve for receiving the arc adjustment engaging member and for guiding the member between the extended position and the retracted position.

3. The sprinkler according to claim 1 wherein the arc adjustment engaging member has an upper collet that expands and contracts radially to capture the portion of the tool as the member moves from the extended position to the retracted position.

4. The sprinkler according to claim 1 wherein the arc adjustment engaging member has a pinion gear at a lower end thereof for engaging a bull gear of the arc adjustment means.

5. The sprinkler according to claim 1 wherein the arc adjustment engaging member has an upper collet with slots for receiving flanges of the tool.

6. The spriker according to claim 1 wherein the arc adjustment engaging member has a collet at an upper end thereof with a plurality of circumferentiaily spaced, longitudinally extending slits.

7. The sprinkler according to claim 1 wherein the arc adjustment engaging member has a collet at an upper end thereof with a ring, and a plurality of circumferentially spaced, longitudinally extending slits that extend through the ring.

8. The sprinkler according to claim 1 wherein the head has a guide sleeve for receiving the arc adjustment engaging member and for guiding the member between the extended position and the retracted position, and further wherein the guide sleeve has a progressively narrowing diameter moving in a downward direction for radially contracting the member as it moves from the extended position to the retracted position to capture and hold the portion of the tool.

9. The sprinkler according to claim 8 wherein the member has a collet with a pair of slots and a ring, and the tool has a pair of flanges that engage with corresponding ones of the slots, and the flanges can only be pulled out of the member when the member is moved to its extended position where it can expand in a radial direction.

10. The sprinkler according to claim 1 wherein the member includes a radially expandable and collapsible collet forming an upper portion of the member, a pinion gear forming a lower portion of the member, and a shaft connecting the collet and the pinion gear and forming an intermediate portion of the member.

11. A sprinkler, comprising:

a housing having an outlet end;

a head including a nozzle for ejecting a stream of water;

means for mounting the head at the outlet end of the housing for angular rotation about a vertical axis;

means mounted in the housing for driving the head about the axis;

arc adjustment means mounted in the housing for pre-setting at least one of a pair of end limits of rotation of the head;

means for causing the rotation of the head to reverse a direction of rotation thereof when a rotational position of the head reaches each of the end limits so that the stream of water will travel through a predefined angular sector;

a vertical guide sleeve in the head;

an arc adjustment tool engaging member slidably and rotatably mounted in the vertical guide sleeve and having an upper portion for receiving a portion of an arc adjustment tool and a lower portion cooperating with the arc adjustment means to permit manual rotation of the tool to rotate the arc adjustment tool engaging member to pre-set the one end limit of rotation of the head, the arc adjustment tool engaging member being vertically moveable between an extended upper position in which the lower portion of the arc adjustment tool engaging member is disengaged with the arc adjustment means and a retracted lower position in which the lower portion of the tool is engaged with the arc adjustment means; and wherein there is no spring biasing the arc adjustment tool engaging member to the extended upper position so that the tool need not be manually held down during rotation of the tool in order to adjust the one end limit of rotation of the head.

12. The sprinkler of claim 11 wherein the guide sleeve is tapered.

13. The sprinkler of claim 11 wherein the upper portion of the arc adjustment tool engaging member includes an upper collet that expands and contracts radially to capture the portion of the tool as the member moves vertically downwardly from the extended upper position to the retracted lower position.

14. The sprinkler of claim 11 wherein the lower portion of the arc adjustment tool engaging member includes a pinion gear for engaging a gear of the arc adjustment means.

15. The sprinkler of claim 11 wherein the upper portion of the arc adjustment tool engaging member is configured to retain and hold the tool and prevent withdrawal of the tool from the member unless the arc adjustment tool engaging member is in its extended upper position.

16. The sprinkler of claim 11 wherein the guide sleeve has a stepped internal diameter.

17. The sprinkler of claim 11 wherein the guide sleeve has a shoulder that provides a stop limiting movement of the arc adjustment tool engaging member in a downward direction.

18. The sprinkler of claim 11 wherein the arc adjustment tool engaging member is configured to lock and hold the portion of the tool when the member is moved to its retracted lower position.

19. The sprinkler of claim 13 wherein the collet has a pair of slots and a ring, and the tool has a pair of flanges that engage with corresponding ones of the slots, and the flanges can only be pulled out of the arc adjustment tool engaging member when the member is moved to its extended upper position where it can expand inside the guide sleeve in a radial direction.

20. The sprinkler of claim 11 wherein the upper portion of the member includes a radially expandable and collapsible collet, the lower portion of the member includes a pinion gear, and a shaft connects the collet and the pinion gear and forms an intermediate portion of the member.

* * * * *

UNITED STATES PATENT AND TRADEMARK OFFICE

CERTIFICATE OF CORRECTION

PATENT NO. : 6,042,021

DATED : March 28, 2000

INVENTOR(S) : Mike Clark

It is certified that error appears in the above-identified patent and that said Letters Patent is hereby corrected as shown below:

In line 3 of the ABSTRACT, delete "contrastable" and insert - - contractable - - .

In column 6, in line 13, after "about" insert - - a- - ; and in line 53, delete "circumferentiaily" and insert - - circumferentially - - .

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,042,021
DATED : March 28, 2000
INVENTOR(S) : Mike Clark

It is certified that error appears in the above-identified patent and that said Letters Patent is hereby corrected as shown below:

Title page,
Item [57], ABSTRACT,
Line 3, delete "contrastable" and insert -- contractable --.

Column 6,
Line 13, after "about" insert -- a --; and
Line 53, delete "circumferentiaily" and insert -- circumferentially --.

Signed and Sealed this

Twenty-first Day of January, 2003

JAMES E. ROGAN
*Director of the United States Patent and Trademark Office*